US008845561B2

(12) United States Patent
Khan et al.

(10) Patent No.: US 8,845,561 B2
(45) Date of Patent: Sep. 30, 2014

(54) NON-INVASIVE METHOD OF SPINAL INTERVENTION AND USE OF DEVICES EFFECTIVE FOR SPINAL INTERVENTION

(75) Inventors: Aslam Khan, Vancouver (CA); Geoffrey T. Desmoulin, Vancouver (CA); Christopher J. Hunter, Calgary (CA)

(73) Assignee: Aslam Khan, St. Michael (BB)

( * ) Notice: Subject to any disclaimer, the term of this patent is extended or adjusted under 35 U.S.C. 154(b) by 153 days.

(21) Appl. No.: 13/433,820

(22) Filed: Mar. 29, 2012

(65) Prior Publication Data

US 2012/0184885 A1 Jul. 19, 2012

Related U.S. Application Data

(63) Continuation-in-part of application No. 10/599,295, filed on Apr. 23, 2008, now Pat. No. 8,152,747, which is a continuation of application No. PCT/CA2005/000353, filed on Mar. 8, 2005.

(51) Int. Cl.
*A61H 1/00* (2006.01)

(52) U.S. Cl.
USPC ..... 601/48; 601/46

(58) Field of Classification Search
USPC ..... 601/46, 47, 48, 71; 607/17; 600/17, 481
See application file for complete search history.

(56) References Cited

U.S. PATENT DOCUMENTS 3,880,170 A * 4/1975 Popov ..... 607/71
4,243,025 A 1/1981 Jones
4,461,286 A 7/1984 Sweat
4,541,417 A * 9/1985 Krikorian ..... 600/17
4,549,535 A 10/1985 Wing
4,700,573 A * 10/1987 Savord ..... 73/625
5,217,019 A * 6/1993 Hughes ..... 600/481
5,408,409 A 4/1995 Glassman et al.
5,618,315 A 4/1997 Elliott (Continued)

FOREIGN PATENT DOCUMENTS

AU 2005226795 10/2005
CA 2206889 7/1996

(Continued)

OTHER PUBLICATIONS

WIPO, Canadian International Searching Authority, International Search Report mailed Sep. 23, 2011, International Patent Application No. PCT/IB2011/052190, 5 Pages.

(Continued)

*Primary Examiner* — Michael A. Brown
(74) *Attorney, Agent, or Firm* — Cameron IP

(57) ABSTRACT

The present technology is the use of the combination to treat a patient and the treatment of a patient. Sine waves are generated digitally by the combination. Data validation is used to ensure correct directional alignment prior to device activation. Patient safety and consistency in treatment protocols are considered in the spinal and upper cervical impulse treatment design. A patient is treated with smooth sinusoidal waveform with a force of about 8 N to about 12.2 N with a Z-axis of acceleration (shear acceleration) of about 0.5 g to about 5g at about 5 Hertz (Hz) to about 200 Hertz. Treatment conditions can be varied depending upon the size of the patient, which includes human and veterinary patients. The method is non-invasive.

20 Claims, 10 Drawing Sheets

(56) References Cited

U.S. PATENT DOCUMENTS

| | | | |
|---|---|---|---|
| 6,228,042 | B1 | 5/2001 | Dungan |
| 6,539,328 | B1 | 3/2003 | Cremonese et al. |
| 6,585,668 | B2 | 7/2003 | Nissim |
| 6,602,211 | B2 | 8/2003 | Tucek |
| 7,517,328 | B2 | 4/2009 | Hoffmann |
| 2001/0014781 | A1 | 8/2001 | Nissim |
| 2003/0230698 | A1 | 12/2003 | Strauss et al. |
| 2005/0054958 | A1 | 3/2005 | Hoffmann |
| 2008/0312724 | A1 | 12/2008 | Khan et al. |

FOREIGN PATENT DOCUMENTS

| | | |
|---|---|---|
| CA | 2439667 | 3/2005 |
| EP | 0101081 | 2/1984 |
| RU | 2025144 | 12/1994 |
| RU | 2195251 | 12/2002 |
| WO | 0100274 | 1/2001 |

OTHER PUBLICATIONS

WIPO, Canadian International Searching Authority, Written Opinion of the International Searching Authority mailed Sep. 23, 2011, International Patent Application No. PCT/IB2011/052190, 6 Pages.

CIPO, Examiner's Report mailed Apr. 19, 2013, Canadian Patent Application No. 2760509, 3 Pages.

CIPO, Examiner's Report mailed Jan. 9, 2014, Canadian Patent Application No. 2760509, 3 Pages.

Desmoulin G.T. et al., "Spinal mechanism of pain control", Clinical Journal of Pain, vol. 23, Issue 7, Sep. 7, 2007, pp. 576-585.

English Abstract of RU 2195251 obtained from esp@cenet on Apr. 14, 2014.

English Abstract of RU 2025144 obtained from esp@cenet on Apr. 14, 2014.

English Abstract of EP 0101081 obtained from esp@cenet Apr. 15, 2014.

WIPO, Canadian International Searching Authority, Written Opinion of the International Searching Authority mailed May 16, 2005, International Patent Application No. PCT/CA2005/000353, 5 pages.

WIPO, Canadian International Searching Authority, International Search Report of the International Searching Authority mailed May 16, 2005, International Patent Application No. PCT/CA2005/000353, 3 pages.

Skoromets A.A. et al. Magnetic stimulation in restorative therapy of patients with spondylogenic diseases of nervous system. Zh Nevrol Psikhiatr Im S S Korsakova. 1997;97(12):28-31. (Abstract in PubMed, PMID: 9591061).

IP Australia, Examiner Report mailed Dec. 23, 2009, Patent Application No. 2005226795, 2 pages.

Canadian Intellectual Property Office, Examiner Report mailed Mar. 8, 2011, Patent Application No. 2,559,903, 2 pages.

Canadian Intellectual Property Office, Examiner Report mailed May 18, 2010, Patent Application No. 2,559,903, 2 pages.

* cited by examiner

NON-INVASIVE METHOD OF SPINAL INTERVENTION AND USE OF DEVICES EFFECTIVE FOR SPINAL INTERVENTION

CROSS REFERENCE TO RELATED APPLICATIONS

This application is a continuation-in-part of U.S. application Ser. No. 10/599,295, filed Apr. 23, 2008 which is a continuation of PCT/CA05/00353, filed on Mar. 8, 2005 both entitled Spinal and Upper Cervical Impulse Treatment and Device, the contents of which are incorporated herein by reference.

FIELD

The present technology is related to an apparatus and uses of the apparatus for spinal intervention in the treatment of patients. More specifically, the technology relates to a non-invasive treatment using an impulse delivery device and the apparatus therefor.

BACKGROUND

Disc Degeneration:

Chronic back pain is a significant health problem associated with degeneration of the intervertebral discs. Traditionally, treatment is varied and focused on the symptoms instead of at the root of discogenic back pain, the disc itself. The more conservative approaches include general exercise, specific conditioning of back and abdominal muscles to help stabilize hyper-mobile regions, spinal manipulation to increase the range of motion for hypo-mobile regions, massage therapy, and transcutaneous electrical nerve stimulation. The more invasive treatments involve the use of medications such as analgesics, opiates, anticonvulsant agents, or antidepressants; minimally invasive treatments such as acupuncture, epidural, and facet joint corticosteriod injections, and spinal nerve blocking techniques. The most invasive treatments involve surgical intervention, ranging from microdiscectomy and spinal fusion to laminectomy.

Despite the multitude of treatments and clinical studies, discogenic back pain still remains one of the most elusive ailments of our time and lacks standardized guidelines for treatment that uniformly achieve acceptable results. In fact, within the framework of evidence-based medicine, the best treatment for discogenic back pain remains cognitive intervention combined with physical exercises specific for stabilizing the spine.

The mechanical properties of the intervertebral discs play an important role in their functionality. Disc degeneration is often characterized by reduced disc height and increased stiffness, leading to bulging or herniation which can create pressure on the radiating nerves and spinal cord. The dominant treatment at present is spinal fusion, wherein two or more adjacent vertebral bodies are physically locked together using bone graft or instrumentation. While this procedure often successfully eliminates stenosis and restores disc height, thus reducing nerve pressure, degeneration of adjacent motion segments is a common long-term complication through negative changes in joint dynamics.

Mean Axis of Rotation:

Patients with neck pain typically do not exhibit obvious abnormalities in plain neck radiographs. Noting the lack of effectiveness of neck range of motion investigations, investigators began exploring the notion of the quality of motion of the cervical vertebrae, they reasoned that while range of motion may be normal, abnormalities of the cervical spine might be revealed by abnormal motion patterns within individual joints. When a cervical vertebra moves from full flexion to full extension, its path appears to lie along an arc whose center lies somewhere below the moving vertebra, this center is called the mean axes of rotation [MAR] or Instantaneous Axis of Rotation [IAR] and its location can be determined using geometry. van Mameren et al. (1992) showed that in contrast to cervical range of motion, a given MAR can be reliably calculated within a small margin of technical error (11).

Abnormal Mean Axes of Rotation:

Abnormal MARs were investigated by Amevo et al. (1992), who studied 109 patients with post-traumatic neck pain (13). The MAR locations were subsequently compared with previously determined normative data. It emerged that 72 percent of the patients with neck pain exhibited at least one abnormally located cervical MAR. The relationship between axis location and pain was highly significant statistically [$P<0.001$]. However, there was no evident relationship between the segmental level of an abnormally located MAR and the segment found to be symptomatic on the basis of provocation discography or cervical zygapophysial joint blocks.

Gene Expression in the Nucleus Pulposus:

The intervertebral discs (IVDs) provide mobility and a degree of shock absorbance to the spinal column. They also transmit forces between the adjacent vertebrae and prevent direct contact between the bones. It has been shown that the mechanical properties of the intervertebral discs play an important role in their functionality. Disc degeneration is often characterized by reduced disc height and stiffness, resulting in pressure on the radiating nerves. The dominant surgical treatment at present is spinal fusion, wherein two or more adjacent vertebral bodies are physically locked together using bone graft or instrumentation. While this procedure often successfully restores disc height and allows for the return of a pain-free lifestyle, degeneration of adjacent motion segments (adjacent segment disease) is a common long-term complication. While initially thought to be a rare event, adjacent segment disease is becoming more of a concern. One current theory states that by fusing dynamics of the joint, they are altered in a way that affects the healthy discs next to the fused segment, likely by altering loading and kinematics on these adjacent discs.

Vibration Treatment:

Vibration treatment has been used for centuries for the treatment of various ailments. Initially, treatment was provided with bare hands. As it became evident that a more controlled method of treatment was needed, devices and protocols were developed to provide a controlled vibration. As a result, we now have methods for increasing bone density, for reducing pain associated with osteoarthritis and soft tissue injury and for reducing lower back pain, to name a few. For example, McLeod (5376065) disclosed that sinusoidal waves having a frequency of 10-110 Hz with an amplitude of 0.01-2 mm and an acceleration of 0.05-0.5 g can improve bone density in patients. Mathes (US Publication No. 20100121131) disclosed that any waveform ranging in frequency from 1-146 Hz with an acceleration of 0.05-0.5 g can reduce pain associated with osteoarthritis and soft tissue injury. Desmoulin et al. (Journal of Musculoskeletal Pain, Vol 15, 3 pp 91-105) and Desmoulin et al. (Clinical Journal of Pain, Vol 23, 7, 576-585) disclosed the use of the Khan Kinetic Treatment (KKT) for reducing lower back pain. The treatment involved vibration at 80-120 Hz with a maximum displacement of 5 mm, however, it was suggested that the frequency could range from 20-300 Hz. The treatment device used is disclosed in Khan et al. (US Publication No. 20080312724), which is incorporated herein in its entirety by reference. The device delivers multiple impulses of variable frequency and variable force in a linear direction, as well as rotational forces, for patient treatment. The apparatus produces smooth sinusoidal waveforms ranging from 50 to 110 Hz for treatment of spinal and upper cervical vertebrae.

SUMMARY

In order to provide highly repeatable and accurate treatment of the skeleton, and more specifically the spine, an assembly is provided. The assembly comprises:

a body imaging device for creating images of a plurality of spinal vertebrae of the patient;

a processor for determining a treatment vector;

a device for treating the patient, the device comprising a stylus, a controller and an actuator for driving the stylus in a linear direction, the device configured to:

allow for alignment of the stylus on the treatment vector and placement on a vertebrae of the patient;

provide a repetitive sinewave impulse of having a force of about 5.5 N to about 12.2 N with a shear acceleration of about 0.5 g to about 50 at about 5 Hertz (Hz) to about 175 Hertz. The assembly preferably includes a treatment table. The device preferably is configured to provide a frequency sweep of about 50 to about 110 Hz with an acceleration of about 0.5 g, at a force of 10.3 Newtons (N).

In another embodiment, a use of the device in the treatment of a patient is provided.

In yet another embodiment, a method of treating a patient in need thereof is provided, comprising:

imaging a plurality of spinal vertebrae;

determining a treatment vector;

locating a spinal vertebrae;

aligning a stylus along the treatment vector and positioning it on a vertebrae of the patient; and providing a repetitive sinewave impulse of a force of about 5.5 N to about 12.2 N with a shear acceleration of at most about 5 g at about 50 Hertz (Hz) to about 175 Hertz to the vertebrae.

In another embodiment, a method of promoting disc health is provided. The method comprises exposing at least one intervertebral disc to a repetitive sinewave impulse at a force of about 5.5 N to about 12.2 N, each sinewave impulse having an acceleration of about 0.5 g to about 5 g, at 16 Hz followed by a sweep between about 50 to about 80 Hz.

FIGURES

DESCRIPTION

Device Mounting and Device Head Components

Figure 1:
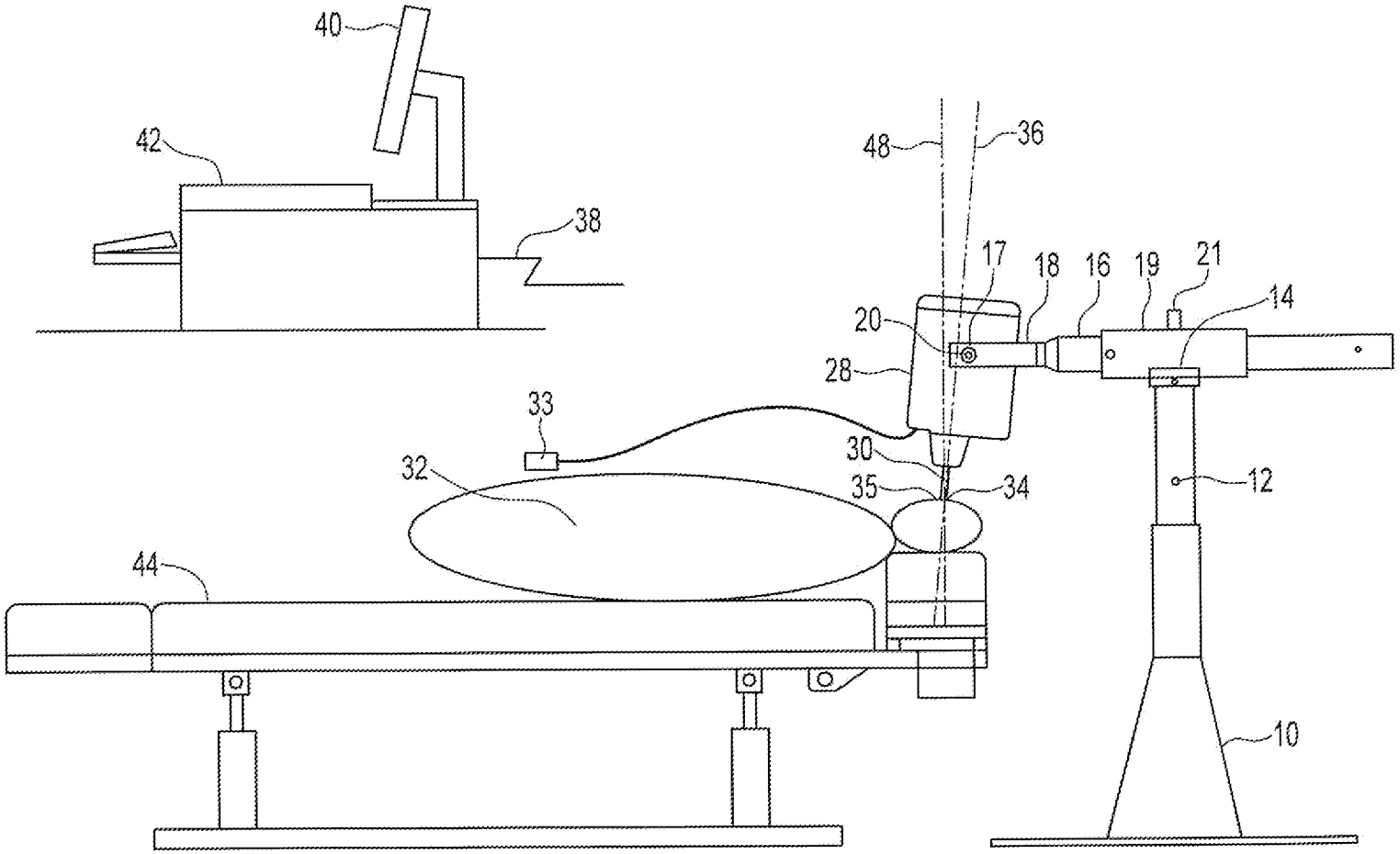
FIG. 1 is a side elevation view of the overall, stand, armature and device head, shown in relation to a patient being treated and a remote computer used to determine automated treatment parameters.

As shown in FIG. 1, a stable stand 30 supports an arm or armature component 16, which in turn supports the impulse treatment device head 28. Arm 16 is slidably enclosed by sleeve 19. The stand 10 can raise or lower the arm 16 by a large retractable piston or linear actuator 12 that is operator controlled. The arm 16 is mounted at the top of the stand's piston 12 at a complex joint with three degrees of freedom, called the stand coupling 14. The stand coupling 14 allows the arm 16 to rotate in a horizontal plane, creating a yaw angle. The transducer head can tilt in this direction but the arm cannot. Last, the stand coupling 14 allows a tilt of the aim 16 off the horizontal plane, creating a roll angle. The aim 16 slides forward and back in sleeve 19 relative to the stand 10. Releasing a lock 21 allows arm 16 to rotate within sleeve 19. A groove in arm 16 and a biased ball bearing in the interior cylindrical surface of sleeve 19 pauses arm 16 to encounter the resistance of having to move the ball bearing out of the groove in arm 16 when rotating arm 16 relative to sleeve 19. A yoke 18 has two arm components, which curve around and attach to the device head 28 by means of dual pivot points 20 on either side of the device head 28. The yoke 18 is supported by arm 16. The yoke 18 is best seen in the top view of the apparatus in FIG. 1A. There is a manual locking mechanism 17 close to the pivot point 20 on one side of the device head 28. A touch screen 26 at the top of the device head 28 displays a user interface which is used for device positioning and control.

A collapsible stylus 30 protrudes from the device head 28 and its end point 34 is used to deliver impulses to a predetermined contact point 35 on a patient's body 32. The point of contact 35 may be the top or atlas vertebra, behind the ear, as shown in FIG. 1. The patient 32 is lying on a bed 44 and the desired contact point 35 is in a fixed location. The many components and degrees of freedom of the device head 28 mounting scheme described above in combination, allow positioning of the linear axis 36 of the device head 28 and collapsible stylus 30 in any direction in three dimensions (3D), while simultaneously keeping the end of the stylus end 34 at a desired fixed location in 3D. For treatment, this fixed location is the contact point 35 on the patient 32.

At the time of treatment, the linear axis of the stylus is in any selected angle 36 in 3D, and this angle is calculated relative to the vertical direction 8 in the preferred embodiment. Angular control is explained below.

Also shown on FIG. 1 is a remote computer 40, which may be in any location and is not necessarily close to the treatment area. Patient data from x-rays and overlaid drawings or other drawings are digitized and input to the remote computer 40 by means of a graphics tablet 42 peripheral. Calculations are made in the remote computer 40 on the raw data and operating parameters are derived. These parameters are sent to the spinal and upper cervical impulse treatment device by means of any data communications link 38, such as a serial data link or wireless link. The types of links are not limited.

Figure 2:
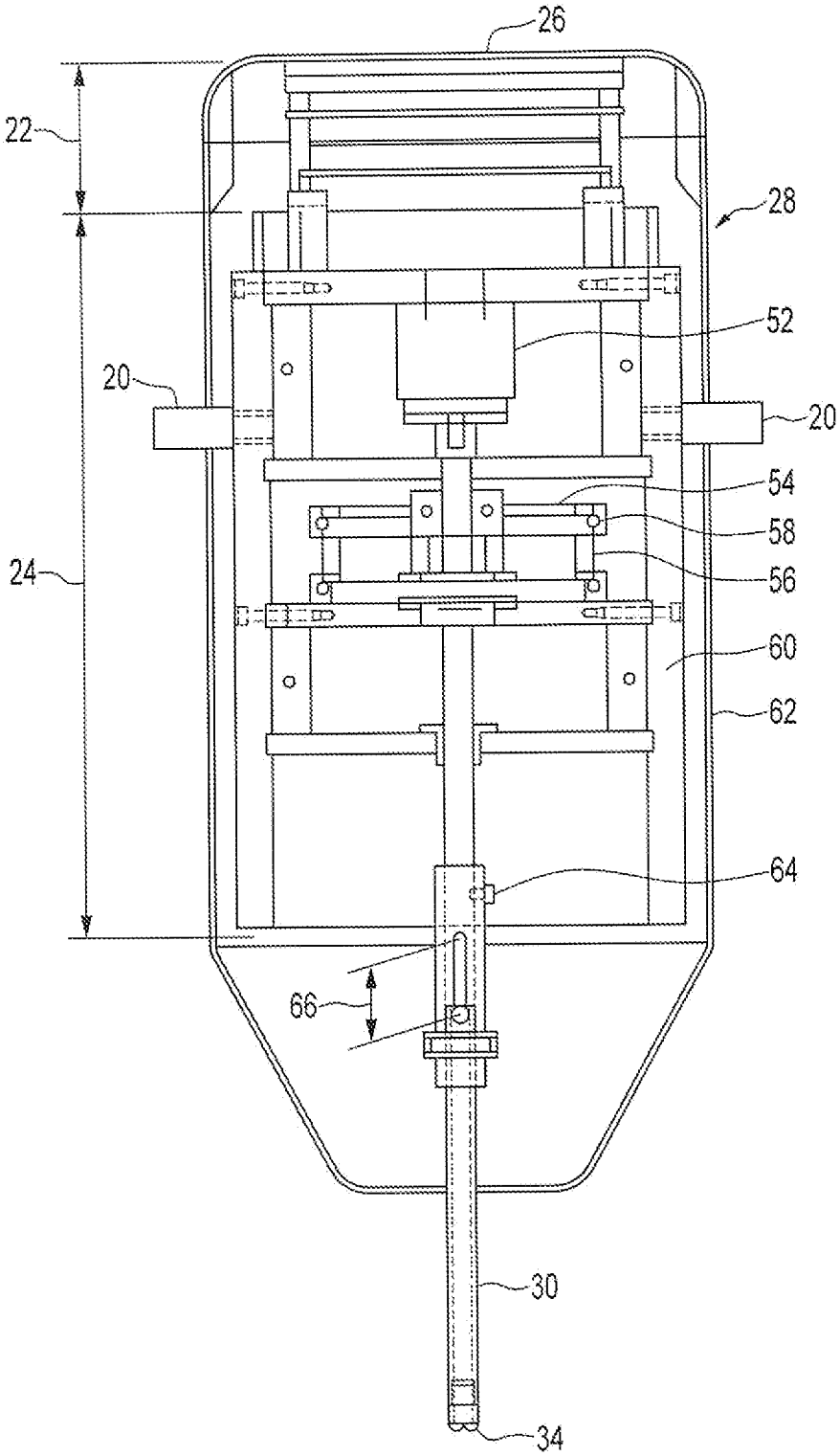
FIG. 2 is a front view of the device head, incorporating a controller with a local user interface, a transducer and stylus, where the latter applies impulses to a patient body.

With reference to FIG. 2, the device head 28 includes a shielded enclosure 62 or housing, designed to conform to EMI standards. A power supply has been removed from the view in FIG. 2. The main components of the device head 28 are a controller 22 section, a transducer 24 section, and the collapsible stylus 30. The controller section includes a touchscreen 26, which displays a user interface and an electronics motherboard 70 (see FIG. 3). The transducer 24 section includes a voice actuator, a stepper motor and other parts to connect them to the collapsible stylus 30. A linear voice coil actuator 52 is attached at the top of the collapsible stylus 30 axis and is used to deliver sinusoidal impulse waveforms along the collapsible stylus 30 linear axis. A large gear 54 holds the collapsible stylus 30 in position along its longitudinally extending axis. The large gear 54 is movable in the axial direction, allowing easy linear motion, but is rigid torsionally. A flexible belt 56 having a toothed surface on one side which engages the large gear 54 is driven by a rotational stepper motor which causes the flexible belt 56 to rotate through a precise angle to deliver a required amount of rotational motion to the collapsible stylus 30 during the time it contacts the patient. Sensors are employed in conjunction with the movement of the belt to limit the angle through which the probe can move. A constant torque is provided by the stepper motor. The voice coil actuator is a precision audio component and is readily commercially available.

Figure 3:
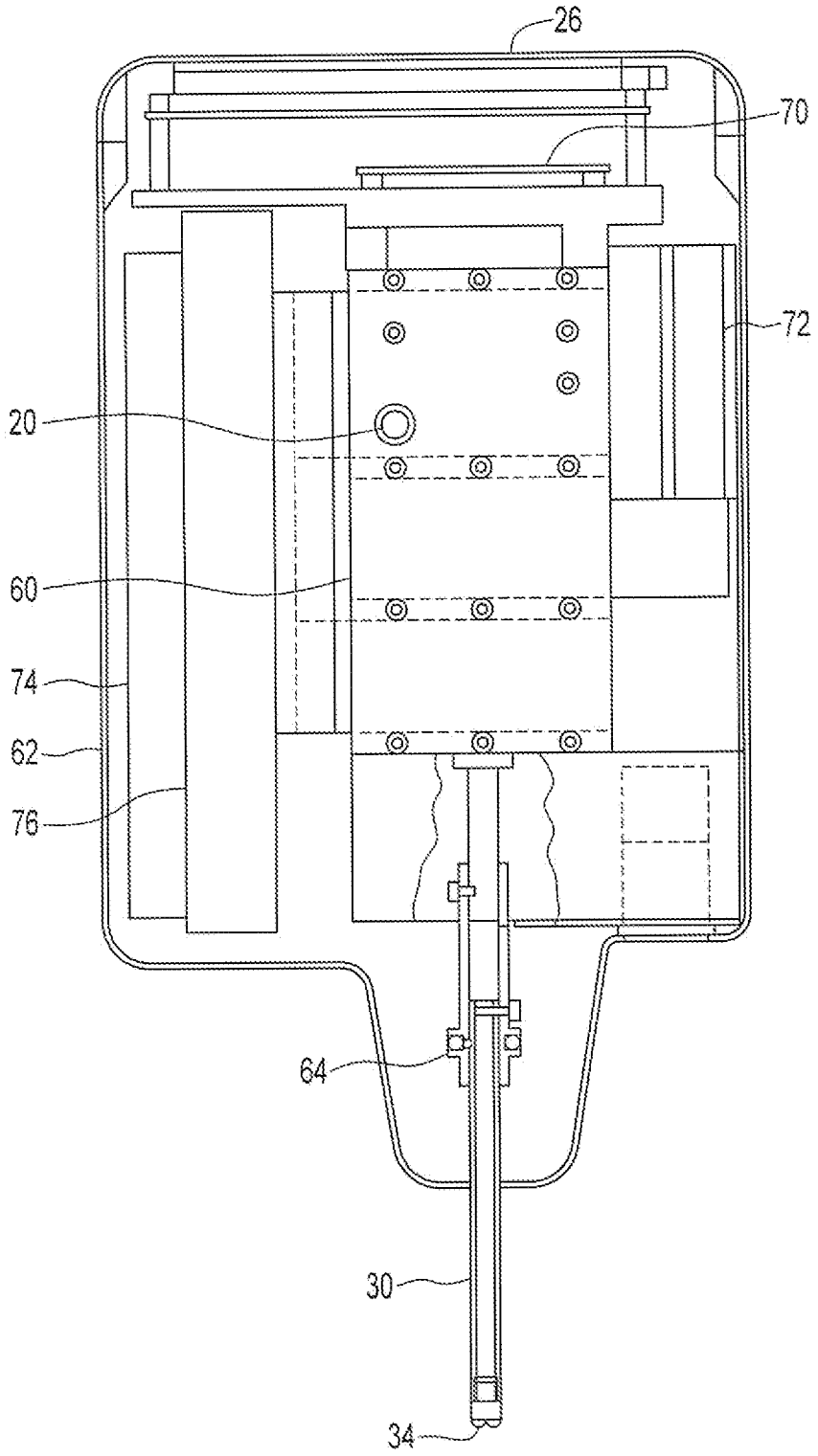
FIG. 3 is a side view of the device head.

FIG. 3 illustrates additional components of the device head, as needed for an electronic device. An optional cooling fan 72 is shown on the right and a large heat sink 76 and power supply 74 are shown on the left. The large heat sink 76 is connected to the transducer frame 60 to dissipate transducer heat and it is connected to the power supply 74, another heat source in the device. The heat sink is aluminum and relatively light for its size, but weight is not a major issue, since the device head is mounted on a fixed stand. The size of the heat sink enables excellent heat dissipation, which is a concern in a medical device. A controller 22, comprised of a touchscreen 26 and electronics motherboard 70, is shown at the top. Components may appear in alternate locations in different device embodiments, although a shielded housing 62 will always be on the outside. The collapsible stylus 30 will always have a linear axis with a measured direction and this will most often be placed approximately along the centerline of the transducer 24 component.

Safety Coupling

Figure 2A:
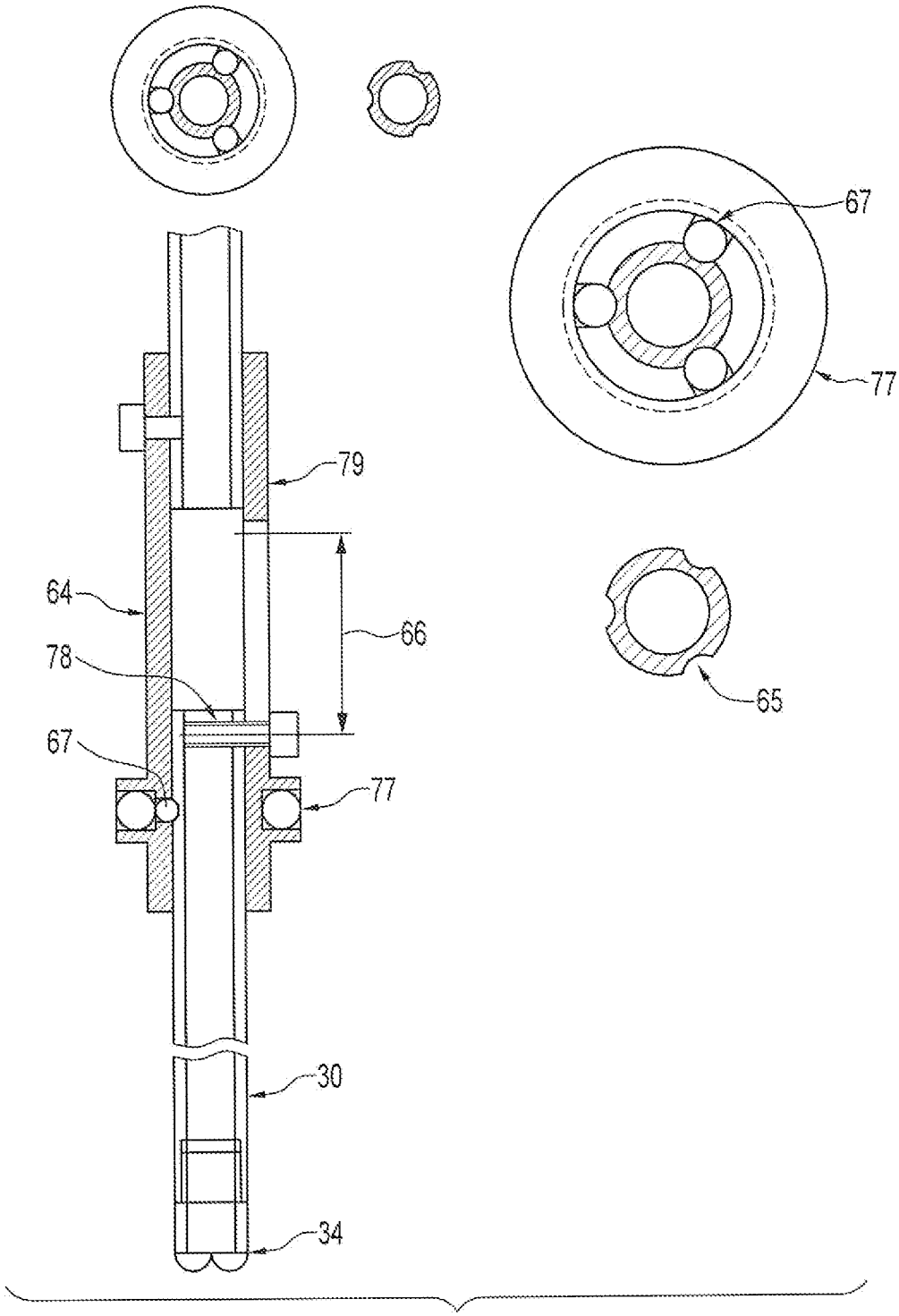
FIG. 2A is a side view of the safety coupling incorporated in the stylus in FIG. 2.

A safety coupling 64 is incorporated along the stylus 30 linear axis as shown in FIG. 2. The safety coupling 64 is an important component, for patient safety, since the patient contact point and stylus end 34 are both in fixed locations in space. The safety coupling allows the stylus to collapse by up to one inch under a moderate applied force in the linear axis, however, the force must exceed the normal treatment force. This safety coupling on the stylus is referred to as the 'collapsible stylus'. The safety coupling 64 is shown in more detail in FIG. 2A. The stylus is comprised of two separate parts, namely an outer sleeve 79, at the top of the safety coupling 64, and a lower stylus tube 30, which fits into the safety coupling sleeve 79. The range of motion 66 of the stylus tube 30 in the sleeve 79 is approximately one inch and is sufficient to avoid injury due to sudden movements by the patient. The range of motion 66 is controlled by a guide pin 78 and slot arrangement, which are also visible in FIG. 2. The degree of force needed to cause stylus 30 to collapse is controlled by an o-ring 77 which presses three steel, balls 67 against the walls of the stylus tube. The three steel balls 67 are at 120 degree angles to one another, as shown in the horizontal cross-section of the o-ring on the right side of FIG. 2A. During normal operation, the three steel balls 67 press into three spherical indents 65 along the stylus tube 30 wall creating a firm contact, so that the sleeve 79 and stylus tube 30 move in tandem. A sufficient force will allow the three steel balls 67 to expand the o-ring 77 so that the balls pop out of the indents 65. The stylus tube 30 then collapses upward into the safety coupling sleeve 79 which incorporates a Hall effect sensor which senses the collapsed position and turns the machine off. The stylus tube 30 is reset manually by pulling on the stylus end 34 until the balls clicks into place. As an additional safety feature, arm 12 cannot be lowered any further into stand 10 once the stylus tube 30 has been collapsed. In addition, the collapsing of the stylus tube 30 shuts off the machine.

Another safety feature is a deadman switch 33 that is operated by the patient to stop the machine in the event of any malfunction.

Transducer and Waveform Characteristics

Transducer 24 design within the spinal and upper cervical impulse treatment device is also aimed at greater accuracy and consistency of operation than available in known devices. Voice coil actuators 52 and 58 are used for both linear and rotational movements, enabling greater accuracy. These components are selected for stability over a range of operating temperatures and may be calibrated at the time of manufacture. Displacement sensors and precision clocks (crystal oscillators) may be used to monitor performance and make dynamic adjustments, as directed by the controller 22, to ensure that calibration is maintained.

Figure 4:
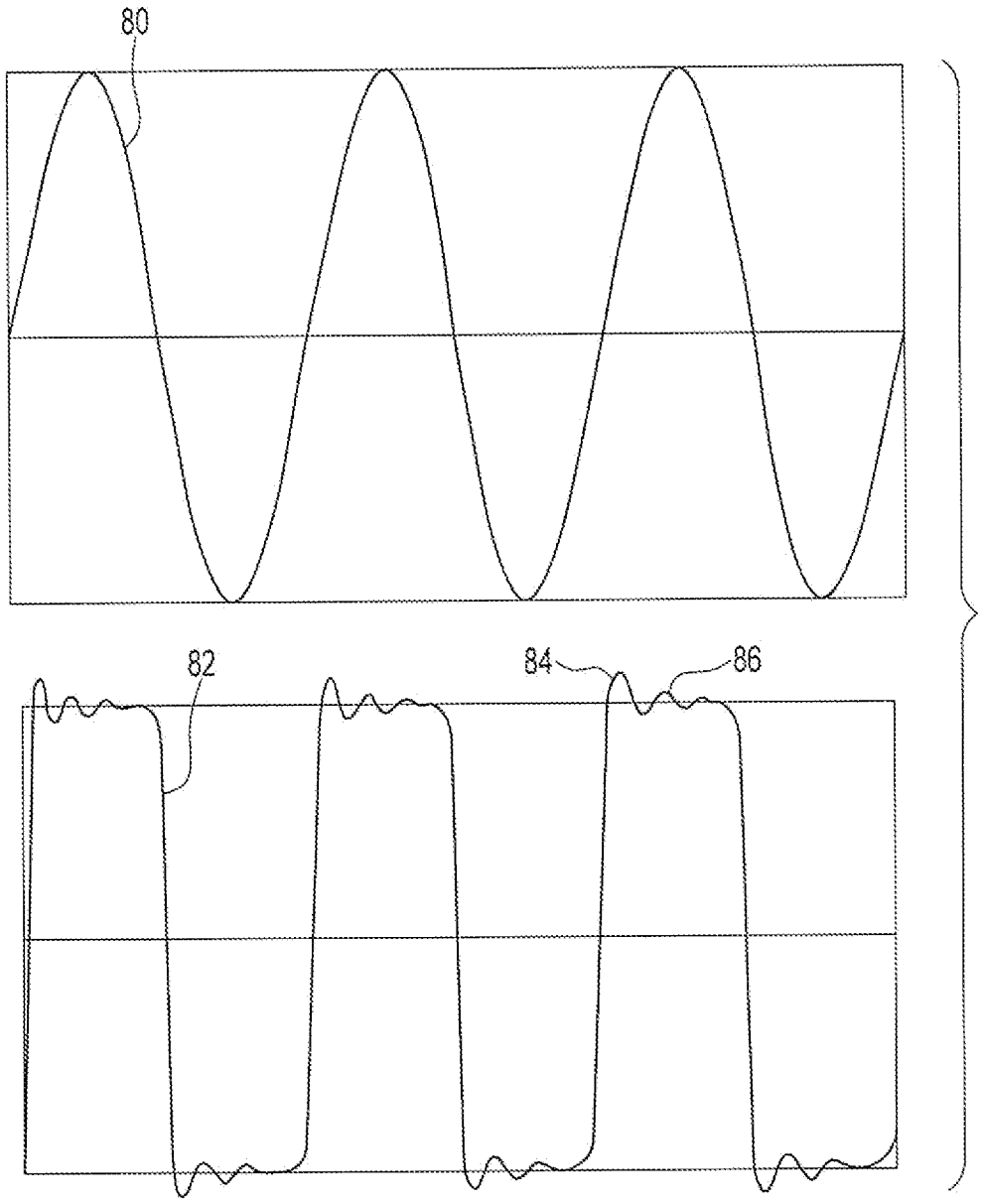
FIG. 4 is a comparison of a sinusoidal versus square waveform.

Sinusoidal waveforms are used for both linear and rotational impulses. A typical, sine wave 80 is shown in the top half of FIG. 4. The smooth nature of the curve is noted, in contrast to the abrupt, and imperfect square wave 82 below. The smooth sinusoidal waveform is judged to be superior for medical applications. The accepted industry technique for generating analog waveforms, and sinusoidal waveforms 80 in particular, is known as Pulse Width Modulation (PWM). Creation of analog waveforms using PWM and low pass filters is well known and well documented. Many companies manufacture and sell controllers or microprocessors that incorporate waveform tables and supply cookbook descriptions of analog waveform generation. Practical low pass filter circuits and their characteristics are included in the documentation. In brief, a high frequency digital output has its duty cycle modified to reflect an analog data value, like a point on a sine wave. This PWM pulse then travels through a low pass filter. The resultant signal carries the desired analog waveform, without use of a digital to analog converter (DAC). The impulse frequencies sought in the current invention are low, and a simple one-stage low pass filter, comprised of a resistor and capacitor, is sufficient to obtain a sine wave 80.

Complex waveforms may be derived from multiple frequencies and these are limited in practice only by the performance characteristics of the voice coil actuators. Precision audio voice coils 52 and 58 will typically operate in the range of 20 Hz to 40 KHz, as designed for stereo equipment and any complex waveform in that range may be produced and implemented in the ICID. The amplitude of the waveform is also selected by the practitioner and represents the impulse energy to be delivered during treatment. Maximum amplitude 96 and high end frequency are set for safety purposes. At present, the Latter is set at 200 Hz.

Figure 5:
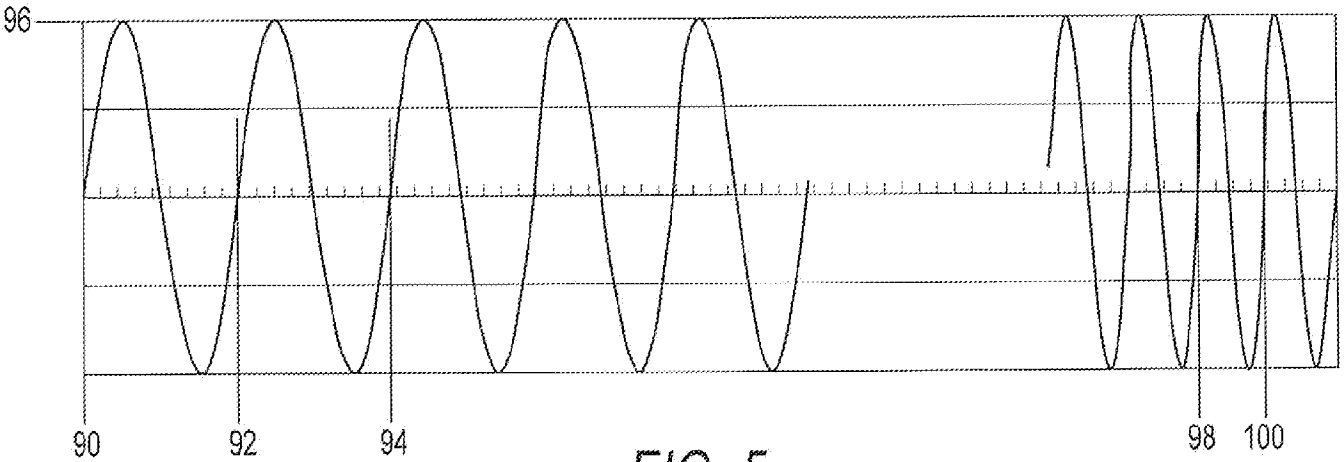
FIG. 5 is a sinusoidal waveform with linearly increasing frequency.
Figure 6:
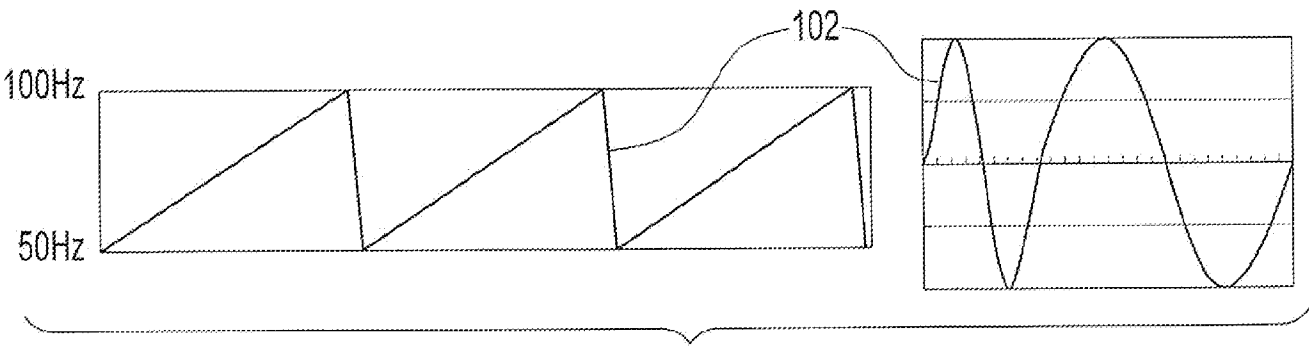
FIG. 6 is a linear frequency ramp and the waveform at the transition point.

The sinusoidal waveform selected for the current invention increases linearly in frequency as a function of time, as shown in FIGS. 5 and 6. Because of its audio characteristic, this waveform is called a chirp. In the preferred embodiment of the invention, the chirp starts with one cycle at 50 Hz 90, followed by cycles at 51 Hz 92, 52 Hz 93, and so on up to 99 Hz 98 and 100 Hz 100. At that time, the frequency resets to 50 Hz and the process starts again. The result is a linear frequency ramp as a function of time, as shown in FIG. 6. With an average frequency of 75 Hz, reset will occur every 0.67 sec. The number of pulses delivered depends on the pulse duration set by the practitioner. This is calculated and known before starting treatment. The frequency ramp in FIG. 6 shows a large discontinuity 102, but this does not appear on the actual impulse waveform applied to the patient. The breakout, diagram on the right illustrates that the discontinuity 102 is just a small change in the slope of the sine wave near the zero crossing, at the transition from 100 Hz to 50 Hz.

To recap, the use of a controller and PWM approach allows the creation of any complex waveform less than the 40 KHz range of the voice coil actuator. The selected waveform for the preferred embodiment of the invention is a linear frequency ramp or chirp, which cycles through 50 Hz to 100 Hz as shown in FIGS. 5 and 6. Square waves 82 will not be implemented in the current invention. A smooth sinusoidal waveform, like one with gradually increasing frequency, is viewed as an ideal impulse waveform for medical treatments.

Rotational impulses are also produced by a geared stepper motor. Typically the angle of rotation will be small, but this is not limited by the stepper motor, but rather by limit switches incorporated into the rotational gear system. The stylus end in contact with the patient has a non-smooth surface, in order to apply the rotational force. The irregular stylus end will have a bar pattern, or cross hairs, or multiple small protrusions. The irregular surface will have smooth edges, as necessary for patient comfort.

Alignment Angle and Data Validation

Figure 7:
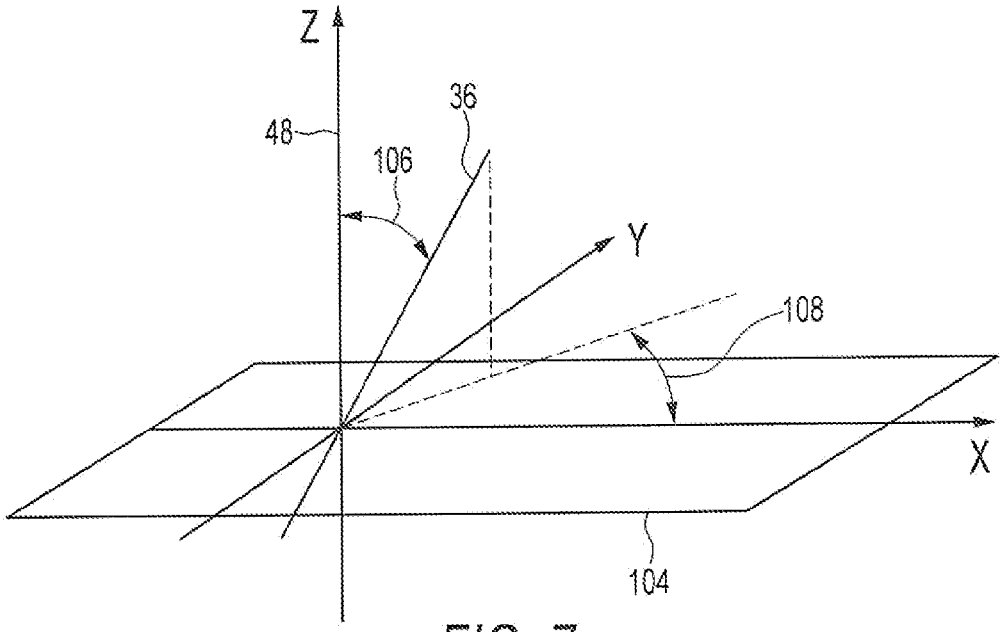
FIG. 7 is a diagram of angular or directional alignment in three dimensions.

A means to measure direction in 3D is shown in FIG. 7. The linear axis 36 of the stylus is represented relative to the vertical direction 48, which corresponds to the Z axis on a conventional 3D Cartesian co-ordinate system. At right angles to the vertical 48, the conventional Cartesian X and Y axes are shown lying in the horizontal plane 104. The direction of the patient bed 44, and zero position and direction of all spinal and upper cervical impulse treatment device components, are known relative to the selected X, Y, Z co-ordinate system. The angular direction of the linear axis 36 is therefore uniquely defined in 3D by the angle from the vertical, alpha 106, and a rotational angle from the X axis, beta 108, in the horizontal plane 104.

A desired treatment angle is determined by a practitioner on the basis of morphological data such as x-rays, physical examination, other inputs, and considerable clinical experience. Practitioners will record and track the efficacy of selected treatment angles across many patients and many situations. It is important to apply linear impulses at a correct treatment angle to obtain consistent results.

Figure 8:
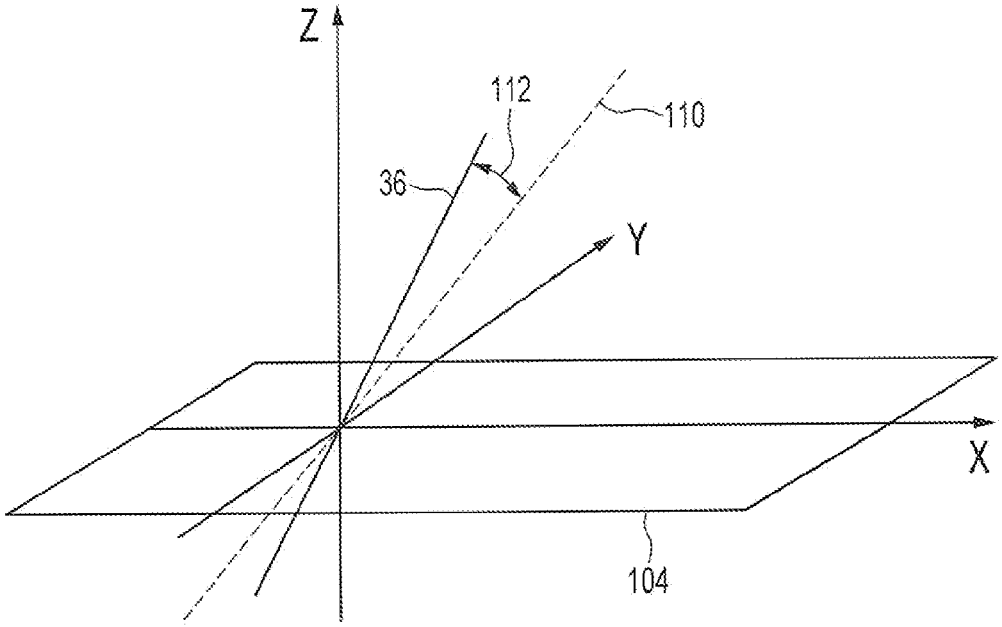
FIG. 8 is a comparison of actual alignment and preset treatment direction.

The current invention includes "data validation" to improve reliability. The actual angle 36 of the linear axis of the collapsible stylus 30 is measured in near real-time, at microsecond intervals, by any common angular measurement device. For example, accelerometers measure angular direction relative to vertical. As shown in FIG. 8, the actual angle 36 of the linear axis of the stylus is compared to the preset treatment angle 110, as defined by the practitioner. The measured linear axis angle 36 and the preset treatment angle 110 must be very close to one another before the device will start-delivering impulses. A maximum angular difference 112 is set by the device manufacturer and higher accuracy options are available to the practitioner. Locking mechanisms are engaged when the correct angular direction is achieved. If the locks fail and angular alignment is lost, the device will stop operating immediately (within microseconds).

This approach removes human error entirely from active treatment. Care must still be taken in setup and automated setup improvement methods are described further below. The current invention overcomes shortcomings in previous devices by preventing operation when the angle of the stylus axis 36 is misaligned relative to the preset treatment, angle 110.

Data validation has many elements. Additional controls are imposed on the device. The time duration of impulses, or number of impulses to be delivered, is automatically controlled in the current invention. Operation does not depend oh a human depressing and releasing a trigger, an approach that lacks accuracy and repeatability. Data validation also pertains to selection of impulse energy or intensity. A maximum impulse energy or sine wave amplitude is built into the transducer and this can be reduced by the practitioner. Maximum rotational angle is predefined. This is a minimum set of controls for the current invention.

Additional elements of data validation may be incorporated into the spinal and upper cervical impulse treatment device, based on experience by practitioners. For example, experience may show that certain frequencies have the best results in certain situations. Extensions in data parameter input, and associated data validation, are within the expected embodiments of the device.

Controller and User Interface

The spinal and upper cervical impulse treatment device is comprised primarily of a touchscreen 26 input panel and electronics motherboard 70. A controller will typically include a microprocessor and various input and output interfaces. As an alternative to the touchscreen 26, the user input panel may be implemented as any convenient combination of display and input components, such as a regular LCD display and keypad, or any other display and input mechanisms, which provide a friendly user interface (UI). Distinctive characteristics of the controller and input means of the spinal and upper cervical impulse treatment device include mounting on or near the device head, as shown in FIG. 2, as well as the friendly UI. By placing the controller 22 in the proximity of the transducer 24, the current, invention ensures that the attention of the practitioner can be focused on the region of the device. This design is preferred to separation of the impulse transducer from its controller, with some displacement between these two components of the system, a situation where a practitioner's attention is split across different regions of the system, and operational errors may occur.

Figure 1A:
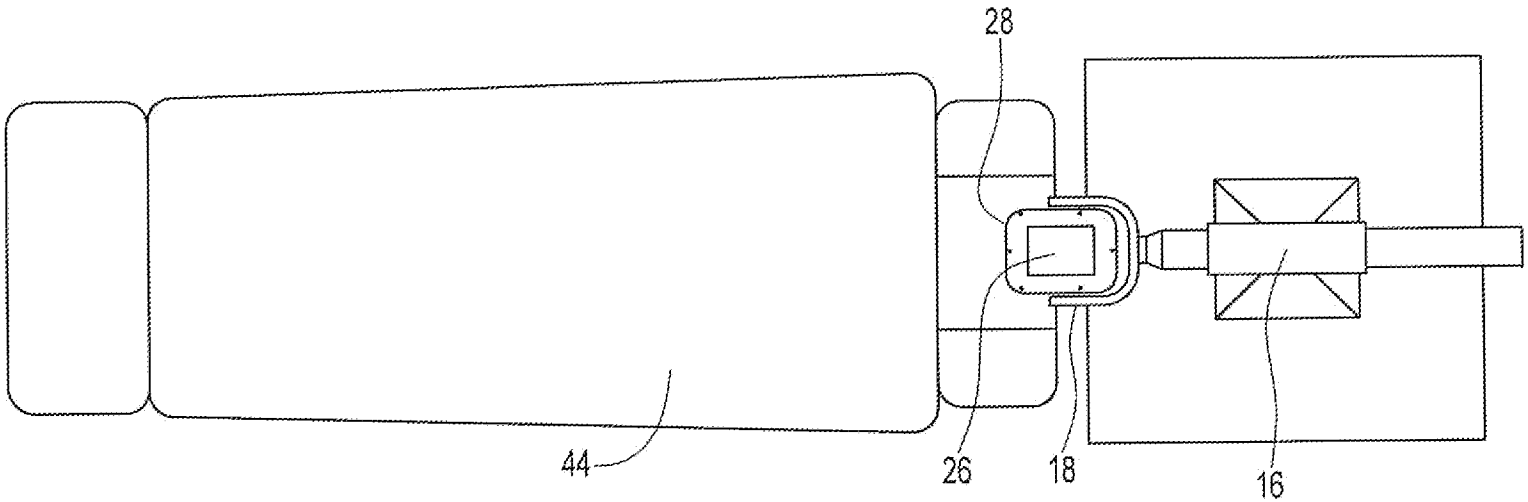
FIG. 1A is a top view of the apparatus in FIG. 1.

A user friendly interface via a touchscreen 26 is shown at the top of the device head 28 in FIG. 1A. The user interface is menu driven. There is a logical sequence to the functions displayed to the practitioner, to enable walk-through of the spinal and upper cervical impulse treatment device operational setup with relative ease. Default parameter settings are allowed as appropriate within treatment protocols. Final treatment parameter settings are to be displayed. Changes may be applied to the setting. There is no need to follow a sequence to adjust settings. Other means of device setup, such as automated data parameter input, are discussed next.

Automated Data Input

Automated data input is an optional but integral part of the spinal and upper cervical impulse treatment, device. A graphics tablet 42 is used to capture information from x-rays and overlaid, diagrams or other diagrams. The input is digitized, allowing the data to be manipulated by computer algorithms. An experienced practitioner has defined the calculations needed to produce the correct preset treatment angle 110. This is matched by the actual angle 36 of the linear axis of the impulse stylus in three dimensions. Other treatment parameters, such as linear and rotational impulse parameters, defining frequency and energy, are then added to fully define the spinal and upper cervical impulse treatment for a particular patient.

All treatment data parameters are organized so that they may be interpreted by the spinal and upper cervical impulse treatment device 22, Data parameters are transferred from a remote computer to the spinal and upper cervical impulse treatment device by any standard communications link 38, such as a serial link, or universal serial bus (USB) port, or wireless data link and the means of communications are not limited.

There are several advantages to automated data input. First, it is more convenient to digitize data from a graphics tablet 42, than to manually calculate and input numbers from a diagram. Once data is in digital form, it can be manipulated by algorithms. Data may be archived on a computer 40, representing many patients and treatment situations. Such historic data and data patterns can be applied to new situations to improve the efficacy of treatment protocols. Once treatment parameters have been defined, these may be automatically compared to other data, as well as being reviewed by an experienced practitioner. Thereafter, treatment parameters are applied by the spinal and upper cervical impulse treatment device, in an accurate and consistent manner, providing overall confidence in treatment protocols.

Patient Therapy Flow Chart

Figure 9:
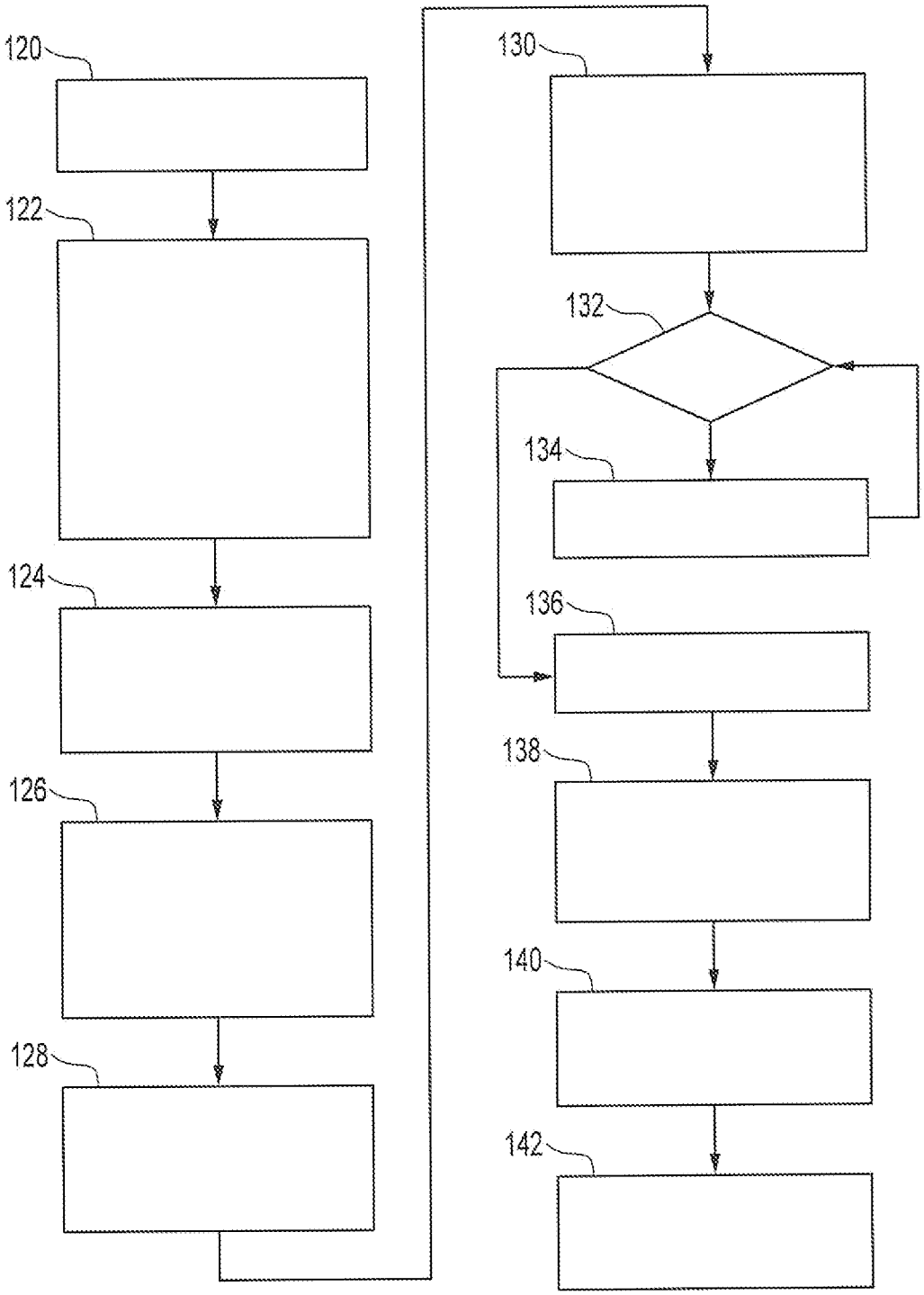
FIG. 9 is a flow chart of the treatment process employing the spinal and upper cervical impulse treatment device.

The therapeutic application of the spinal and upper cervical impulse treatment device is described as a flow chart of operations in FIG. 9. A patient examination and consultation takes place at step 120. At step 122 pre-treatment x-rays are taken as well as static measurements of pelvic/shoulder level and leg length discrepancy, using calipers on the body. Data points of interest are marked on the graphics tablet, such as cervical tilt, head tilt and atlas position, relative to the skull and cervical spine. At step 124, digitised data points are transferred from the graphics tablet to a computer. X-ray analysis is conducted in three dimensions using custom spinal and upper cervical impulse treatment software. At step 126, data parameters for device operation are derived from the spinal and upper cervical impulse treatment software and data archives, including: (a)—linear impulse frequency and duration, (b)—linear impulse angle, (c)—linear impulse force, and (d)—rotational angle. Data parameters are transferred to the spinal and upper cervical impulse treatment software, manually via touch-screen, or automatically via a serial data communications link at step 128. At step 130, impulse parameters are validated in the spinal, and upper cervical impulse treatment software, including maximum impulse force, frequency and duration. Settings are displayed on the touch-screen 26. At step 132, whether the measured linear impulse angular direction is in close agreement with the preset treatment angular direction is tested. The allowed difference is preset. If correct alignment is not achieved, then the system goes to step 134. If alignment is acceptable, then the system goes to step 136. At step 134, the angle of the stylus linear axis is adjusted to try to achieve correct alignment. The system then returns to step 132. At step 136, once angular alignment is achieved, the angle of the linear axis of the stylus is fixed or locked and the location of the stylus end is locked. The spinal and upper cervical impulse treatment transducer is then allowed to start operation. If angular alignment is lost, operation will cease. The calculations in steps 132 and 134 are ongoing during treatment. At step 138, post spinal and upper cervical impulse treatment includes measurement of the impact of treatment on pelvic/shoulder unlevelling and leg length discrepancy, using body calipers. At step 140, following review and recommendations, the patient's next appointment is scheduled as needed. At step 142, post-treatment, x-ray analysis is conducted after 5 weeks, to determine progress and the efficacy of the treatment.

Figure 10:
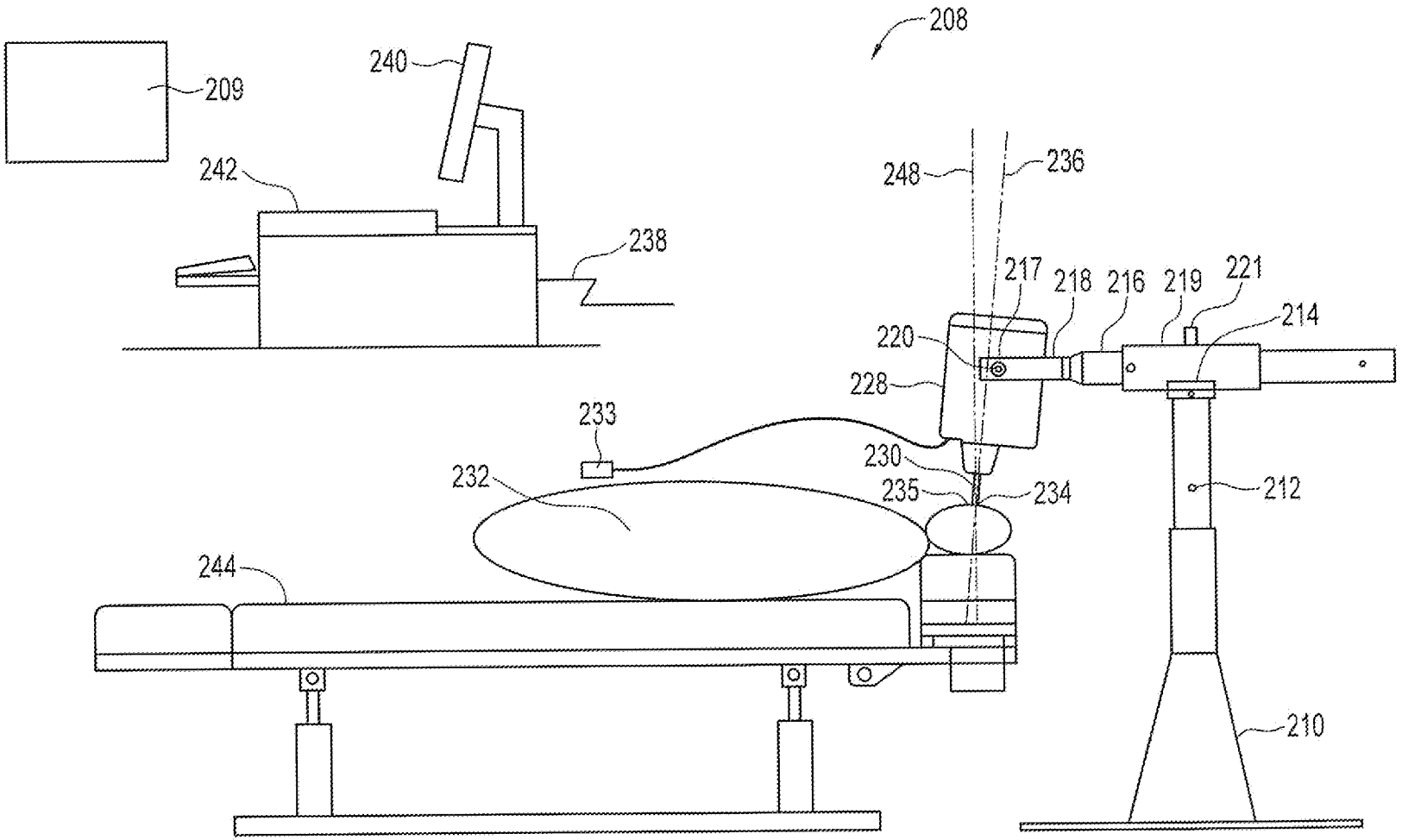
FIG. 10 is a side view of the assembly of the present technology.

The assembly, generally referred to as 208 is shown in FIG. 10. The assembly includes a body imaging device 209, for example, but not limited to, x-ray, magnetic resonance imaging (MRI) or computed axial tomography (CT) machines. A treatment device includes an impulse delivery mechanism comprising a stylus used to deliver waveforms of various frequencies, and amplitudes, both linearly and rotationally to the vertebrae of the spine. A stable stand 210 supports an arm or armature component 216, which in turn supports the impulse treatment device head 228. Arm 216 is slidably enclosed by sleeve 219. The stand 210 can raise or lower the arm 216 by a large retractable piston or linear actuator 212 that is operator controlled. The arm 216 is mounted at the top of the stand's piston 212 at a complex joint with three degrees of freedom, called the stand coupling 214. The transducer head can tilt in this direction but the arm cannot. The stand coupling 214 allows a tilt of the arm 216 off the horizontal plane, creating a roll angle. The arm 216 slides forward and back in sleeve 219 relative to the stand 210. Releasing a lock 221 allows arm 216 to rotate within sleeve 219. A groove in arm 216 and a biased ball bearing in the interior cylindrical surface of sleeve 219 causes arm 216 to encounter the resistance of having to move the ball bearing out of the groove in arm 216 when rotating arm 216 relative to sleeve 219. A yoke 218 has two arm components, which curve around and attach to the device head 228 by means of dual pivot points 220 on either side of the device head 228. The yoke 218 is supported by arm 216. There is a manual locking mechanism 217 close to the pivot point 220 on one side of the device head 228. A touch screen 226 at the top of the device head 228 displays a user interface which is used for device positioning and control.

A collapsible stylus 230 protrudes from the device head 228 and its end point 234 is used to deliver impulses to a predetermined contact point 235 on a patient's body 232. The point of contact 235 may be the top or atlas vertebra, behind the ear, as shown in FIG. 10. The patient 232 is lying on a treatment bed 244 and the desired contact point 235 is in a fixed location. The many components and degrees of freedom of the device head 228 mounting scheme described above in combination, allow positioning of the linear axis 236 of the device head 228 and collapsible stylus 230 in any direction in three dimensions (3D), while simultaneously keeping the end of the stylus end 234 at a desired fixed location in 3D. For treatment, this fixed location is the contact point 235 on the patient 232.

At the time of treatment, the linear axis of the stylus is in any selected angle 236 in 3D, and this angle is calculated relative to the vertical direction 208 in the preferred embodiment.

Also shown on FIG. 10 is a remote computer 240, which can be any processor, which may be in any location and is not necessarily close to the treatment area. Patient data from x-rays and overlaid drawings or other drawings are digitized and input to the remote computer 240 by means of a graphics tablet 242 peripheral. Calculations are made in the remote computer 240 on the raw data and operating parameters are derived. These parameters are sent to the spinal and upper cervical impulse treatment device by means of any data communications link 238, such as a serial data link or wireless link.

Example 1

Treatment of Human Lumbar Vertebrae

X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a lumbar vertebrae in the vicinity of the transverse process of the vertebrae. Treatment will be at a force of less than about 5 pounds, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 2

Treatment of Human Thoracic Vertebrae

X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a thoracic vertebrae in the vicinity of the transverse process of the vertebrae. Treatment will be at a force of less than about 5 lbs, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 5 minutes, more preferably 10 minutes, and can be as long as 15 minutes. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 3

Treatment of Human Cervical Vertebrae

X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a cervical vertebrae in the vicinity of the transverse process of the selected vertebrae—it need not be C1. Treatment will be at a force of less than about 5 lbs, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 4

Treatment of Large Animal Lumbar Vertebrae

Large animals, for example, but not limited to, horses and cattle can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the hide of a patient adjacent a lumbar vertebrae in the vicinity of the transverse process of the vertebrae. Treatment will be at a force of less than about 9 pounds, preferably less than about 7 lbs, and most preferably less than about 5 lbs (about 40 N, about 31 N and about 22 N, respectively). The average Z-axis acceleration will be about 2.2 g, but can range from about 1.7 g to about 5 g, including 3.65 g. The treatment time will be at least about 5 minutes, more preferably 10 minutes, and can be as long as 15 minutes. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 5

Treatment of Large Animal Thoracic Vertebrae

Large animals, for example, but not limited to, horses and cattle can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the hide of a patient adjacent a thoracic vertebrae in the vicinity of the transverse process of the vertebrae. Treatment will be at a force of less than about 9 pounds, preferably less than about 7 lbs, and most preferably less than about 5 lbs (about 40 N, about 31 N and about 22 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 6

Treatment of Large Animal Cervical Vertebrae

Large animals, for example, but not limited to, horses and cattle can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the hide of a patient adjacent a cervical vertebrae in the vicinity of the transverse process of the selected vertebrae—it need not be C1. Treatment will be at a force of less than about 9 pounds, preferably less than about 7 lbs, and most preferably less than about 5 lbs (about 40 N, about 31 N and about 22 N, respectively). The average Z-axis acceleration will be about 2.2 g, but can range from about 1.7 g to about 5 g, including 3.65 g. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 7

Treatment of Small Animal Lumbar Vertebrae

Small animals, for example, but not limited to, dogs and cats, can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a lumbar vertebrae in the vicinity of the transverse process of the vertebrae. Treatment will be at a force of less than about 5 lbs, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 8

Treatment of Small Animal Thoracic Vertebrae

Small animals, for example, but not limited to, dogs and cats, can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a thoracic vertebrae in the vicinity of the transverse process of the vertebrae. Treatment will be at a force of less than about 5 lbs, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 9

Treatment of Small Animal Cervical Vertebrae

Small animals, for example, but not limited to, dogs and cats, can be treated using the method of the present technology. X-ray images or other images suitable for showing spinal alignment will be viewed prior to treatment. If images are not available, imaging will be conducted. A device having a stylus and a driver to generate a sinewave of about 5 Hz to about 200 Hz, more preferably about 8 Hz to about 150 Hz, still more preferably about 25 Hz to about 100 Hz and most preferably about 50 Hz to about 100 Hz will be located on the skin of a patient adjacent a cervical vertebrae in the vicinity of the transverse process of the selected vertebrae—it need not be C1. Treatment will be at a force of less than about 5 lbs, more preferably less than about 4 pounds and most preferably less than about 2.5 lbs (about 22 N, about 18 N and about 11 N, respectively). The average Z-axis acceleration will be about 2.2 g, but can range from about 1.7 g to about 5 g, including 3.65 g. The treatment time will be at least about 2 minutes, more preferably 5 minutes, and can be as long as 10 minutes. Treatment may involve one session, two sessions or multiple sessions. The results will show at least one of reduced pain, reduced disability, increased mobility and increased alignment. X-ray images or other images suitable for demonstrating spinal alignment will be used to determine whether or not the treatment results in increased spinal alignment.

Example 10

Axial vibration was applied by placing individual discs into a chamber filled with cell culture medium. The lid on the chamber was fixed with a spring (k=26.2 N/cm) that applied static axial load (Mean 40.6 N) on the disks during the unconstrained vibration. The chamber had an ±1.7 g accelerometer fixed to it to track the vibration load when the chamber was mounted to a voice coil. The accelerometer was previously calibrated. The vibration of the voice coil was controlled with the output of a Linear Current Amplifier Module which received its command signal from a function generator. The voice coil and chamber were secured with damping to a shelf in a 37° C. and 5% CO2 environmental control chamber. The control signal to the voice coil and the accelerometer output was monitored in real-time via an oscilloscope during the loading. Vibration was applied at various frequencies (0, 8, 16, 20, 30, 40, 50, 60, 70, 80, 160, 200 Hz) and amplitudes (0-0.54 g RMS) for either 10 or 60 minutes. The order of both amplitude and frequency selection was randomly assigned to eliminate any time-dependent trends due to sample storage. All conditions were run on a minimum of 5 separate discs (from at least two different bovine tails).

The results indicated that frequency significantly affected expression of collagen type II, decorin, and versican mRNA. The regression slopes for each of these genes were not significant. Amplitude significantly affected expression of biglycan, collagen type I, collagen type II, decorin, and versican mRNA. The regression slopes for these genes were significant and positive for all of these genes, with the exception of versican, which was not significant. In general, the results indicated a positive effect of axial vibration on extracellular matrix gene expression. Most genes were at or above control levels for most frequencies and amplitude's, with the notable exceptions of biglycan and versican. Both of these genes exhibit complex expression patterns with high and low regions throughout the amplitude spectrum. Regardless of frequency and amplitude, versican expression was reduced after 60 minutes of exposure. In general, it was concluded that the conditions that promoted nucleus pulposus gene expression were about 0.5 g, about 16 Hz for half the time with a sweep from about 50 to about 80 Hz for half the time for 10 minutes.

Example 11

Vibration was applied by placing the stylus of the device disclosed in CA2005/000353 to Khan et al. onto the sensitive region of a 450 N load cell that was fixed over the area of the spinous process of the center vertebrae of the 5 segment bovine tail. Three dimensional ±10 g accelerometers were mounted on a cube and aligned with the axes of the disc (X-axial compression/tension, Y-shear 90 deg out of alignment with applied load, Z-shear parallel with applied load) and glued to the bone using cyanoacrylate to track acceleration of both the loaded and adjacent vertebral bodies. The accelerometers were previously calibrated using a 1 g shaker plate. The voice coil mounted and producing the vibration from within the device was controlled with the output of a Linear Current Amplifier Module which received its command signal from a function generator. The current going to the voice coil and the accelerometer output was monitored in real-time via an oscilloscope during the loading. Imparted mechanics vibration was tested at four different current values (~0.9-1.9 Amp driving current). The testing vibration was applied at two static frequencies (0 or 16 Hz) and/or one sweep frequency (50-80 Hz) that would step up the frequency by 2 Hz every two cycles of oscillation. Each frequency treatment was applied for 10 minutes and one treatment alternated combined frequencies of 16 and 50-80 Hz for 5 minutes each to maintain the overall 10 minute application. All amplitudes were sustained at 0.5-5 g peak root mean square [RMS] of the vertebrae directly receiving the load. This is similar to current clinical treatments using the device, and corresponds to those stimuli eliciting peak responses in previous experiments. The order of control samples versus actual vibration samples was randomly assigned to eliminate any time-dependent trends due to sample storage. All conditions were run on a minimum of 6 separate discs (from at least three different tails). Control discs were treated equally (stored, handled, dissected, and snap-frozen) in order to perform as true unloaded controls.

The results showed non-significant changes in expression of collagen type I and increased expression of aggrecan, collagen type II and versican. This suggests a potential beneficial effect of the current vibration loading pattern tested in the study. When compared to Example 10, it can be concluded that the placement of the stylus of the device on the vertebrae rather than providing unconstrained vibration to the vertebrae provides a further improvement in maintaining and potentially improving disc health through increased gene expression. On the basis of the results of this study and the clinical studies of spinal intervention, a suitable treatment for human patients was determined to be exposing at least one intervertebral disc to a repetitive sinewave impulse at a force of about 5.5 N to about 12.2 N, each sinewave impulse having an acceleration of about 0.5 g to about 5 g, at 16 Hz followed by a sweep between about 50 to about 80 Hz. The preferable treatment was at a force of 0.5 N with an acceleration of 0.5 g. The method is preferably effected using the treatment device disclosed in CA2005/000353 to Khan et al.

Example 12

Using saggital plane cervical x-rays, pre and post intervention MARs were calculated for 44 patients with chronic neck pain. The study used a randomized, single blinded, and sham controlled design for comparisons of outcome measures. The intervention input was assessed using a load cell and vertebral acceleration and the outcome measures were: 1. cervical MARs, 2. self-reported neck pain [11-point scale], 3. neck disability index scores, 4. psycho-social assessments for stress, anxiety, and depression.

The device used was a spinal and upper cervical treatment device consisting of a controller mounted on top of an impulse delivery mechanism, or device head, which is mounted on a movable armature to a fixed stand. The device head generates waveforms [sinewave at 50-110 Hz] and the stylus located at the base of the device head mechanically transduces the waveforms through the skin and ultimately to the spine, causing minor vibration of the vertebrae and minor repetitive stretching/activation of the attached soft tissues. The stylus amplitude is controlled by a touch screen setting called the "Intensity" which ranges from 0 to 1 and controls the amplitude of current that is supplied to the stylus actuator. Treatment is typically given at 0.5 and stylus imparted mechanics has been quantified using in situ bovine tail here in. Patients in both groups were required to undergo treatment, either actual or sham, two or three times per week for a period of four to six weeks with each treatment lasting about 10 minutes. The preferred treatment was an acceleration of about 0.5 g to about 2.2 g, at a force of about 9 N to about 10.5 N and a frequency sweep from about 40 Hz to about 120 Hz for a period of about 30 seconds to about 5 minutes, with repeated individual treatments for 4 to 6 weeks. The more preferred treatment was an acceleration of about 0.5 g to about 1.5 g, at a force of about 9.5 N to about 10.4 N and a frequency sweep of about 45 Hz to about 115 Hz for a period of about 30 seconds to about 2 minutes. The most preferred treatment was an acceleration of about 0.5 g, at a force of 10.3 N, and a frequency sweep of about 50 to about 110 Hz for a period of 30 sec to 2 min, with repeated individual treatments for 4-6 weeks.

The treatment improved pain and neck disability scores significantly compared to sham controls, corrected 62 percent of abnormal MARs with significantly larger MAR vector magnitude differences [pre-post] at the C5-C6 level than shams, and in patients without changes in MAR locations, the treatment significantly improved neck disability scores above the sham group. MAR correction was significantly related to improving both pain and neck disability across all subjects. Hence the study provided biomechanical evidence of spinal "re-alignment" and its ability to improve both pain and neck disability.

Example 13

Caliper measurements were used to determine alignment of the spine, by measuring the shoulder tilt and the hip tilt. As would be known to one skilled in the art, any means that allows a practitioner to assess tilt can be used, for example, but not limited to optical devices or a tape measure. A top skull x-ray image, a lateral x-ray image and a frontal x-ray image were taken to determine the location and orientation of the atlas. As would be known to one skilled in the art, any body imaging device that allows a practitioner to identify spinal vertebrae can be used, for example, but not limited to CT scans or MRI. On the basis of the location and orientation, the physician determined the vector for treatment. For example, if the atlas is tilted up the treatment vector will be down. The vector can be determined manually, but preferably is determined with a suitable processor, for example, but not limited to a computer. The stylus can be placed in the general vicinity of the altas. He then ensured that the stylus angle was correct and positioned the stylus into position on the patient's neck using the pen mark as a locator. The stylus is aligned along the treatment vector. The stylus caused a depression of approximately 2 mm below the skin surface and was on a bony landmark of the transverse process of the atlas, however, the stylus need not be placed on a bony landmark of the transverse process—it can be placed in the general vicinity of the altas. Further, there may be more than one probe, for example two probes. The preferred device for the treatment is one that controls the location and angle of the stylus relative to the patient and provides a highly controlled impulse in the form of a sinusoidal wave. The preferred treatment was an acceleration of about 0.5 g to about 2.2 g, at a force of about 9 N to about 10.5 N and a frequency sweep from about 40 Hz to about 120 Hz for a period of about 30 seconds to about 5 minutes, with repeated treatments weekly, or every two weeks, or every three weeks or every month for 4 to 6 weeks or 6 to 8 weeks, or more, as needed. The more preferred treatment was an acceleration of about 0.5 g to about 1.5 g, at a force of about 9.5 N to about 10.4 N and a frequency sweep of about 45 Hz to about 115 Hz for a period of about 30 seconds to about 2 minutes. The most preferred treatment was an acceleration of about 0.5 g, at a force of 10.3 N, and a frequency sweep of about 50 to about 110 Hz for a period of 30 sec to 2 min, with repeated individual treatments.

The results showed at least one of an improvement of spinal alignment, a reduction in shoulder and/or hip tilt, a reduction in pain, a reduction in swelling and an improvement in mental health.

The foregoing is a description of the technology. As would be known to one skilled in the art, variations are contemplated that do not alter the scope of the technology.

The invention claimed is:

1. A use of an assembly for the treatment of a patient, the assembly comprising:
- a body imaging device for creating images of a plurality of spinal vertebrae of the patient;
- a processor for determining a treatment vector; and
- a device for treating the patient, the device comprising a connector, an impulse treatment head and a stylus, wherein the connector is for connecting the device to a stand, such that in use, the impulse treatment head has multiple degrees of freedom relative to the stand and is configured to produce impulses that drive the stylus in sinusoidal waves along the treatment vector, and the device configured to:
  - allow for alignment of the stylus on the treatment vector and placement on a vertebrae of the patient;
  - provide a repetitive sinewave impulse at a frequency of about 50 Hertz (Hz) to about 200 Hertz.

2. The use of claim 1, wherein the device is configured to provide a force of about 9 N to about 11 N.

3. The use of claim 2, wherein the device is configured to provide acceleration of about 2.2 g.

4. The use of claim 3, wherein the device is configured to provide a frequency of about 50 to about 110 Hz.

5. The use of claim 4, wherein the device is configured to provide a frequency sweep of about 50 to about 110 Hz with an acceleration of about 0.5 g.

6. The use of claim 5 for the treatment of abnormal mean axes of rotation, spinal misalignment or disc degeneration.

7. The use of claim 6 for the treatment of abnormal mean axes of rotation.

8. The use of claim 6 for the treatment of spinal misalignment.

9. The use of claim 6 for the treatment of disc degeneration.

10. The use of claim 6, wherein the stylus is configured to collapse upon meeting resistance of a predetermined force value.

11. A method of treating a patient in need thereof, the method comprising:
- imaging a plurality of spinal vertebrae;
- determining a treatment vector;
- locating a spinal vertebrae;
- aligning a stylus along the treatment vector and positioning it on a vertebrae of the patient; and providing a repetitive sinewave impulse of a force of about 5.5 N to about 12.2 N with a shear acceleration of at most about 5 g at a frequency of about 50 Hz to about 175 Hz to the vertebrae, thereby treating the patient.

12. The method of claim 11 wherein the vertebrae is the atlas and the plurality of spinal vertebrae are cervical vertebrae.

13. The method of claim 12 wherein the acceleration is about 0.5 g.

14. The method of claim 13 wherein the frequency is a sweep of about 50 to about 110 Hz.

15. The method of claim 14 wherein the force is about 10.3 N.

16. The method of claim 13 wherein the treatment is between about 2 minutes to about 5 minutes.

17. The method of claim 13 further comprising determining a mean axes of rotation of the cervical vertebrae.

18. The method of claim 14 for the treatment of abnormal mean axes of rotation.

19. A method of promoting disc health, the method comprising exposing at least one intervertebral disc to a repetitive sinewave impulse at a force of about 5.5 N to about 12.2 N, each sinewave impulse having an acceleration of about 0.5 g to about 5 g at a frequency of about 16 Hz followed by a sweep between about 50 to about 80 Hz.

20. The method of claim 19 wherein the force is 10.3 N, and the acceleration is 0.5 g.

* * * * *